United States Patent [19]

Beeken

[11] Patent Number: 4,615,442

[45] Date of Patent: Oct. 7, 1986

[54] RECEPTACLE FOR ROLL OF SHEET MATERIAL

[75] Inventor: Leslie E. Beeken, Cheyenne, Wyo.

[73] Assignee: Loosey Goosey Waterfowl Products, Inc., Cheyenne, Wyo.

[21] Appl. No.: 705,022

[22] Filed: Feb. 25, 1985

[51] Int. Cl.[4] ..... B65D 85/67

[52] U.S. Cl. ..... 206/397; 206/389; 206/408; 220/375; 242/55.2; 242/55.53

[58] Field of Search ..... 206/316, 389, 394, 397, 206/405, 407, 408, 409; 220/375; 242/55.2, 55.3, 55.42, 55.53, 55.55

[56] References Cited

U.S. PATENT DOCUMENTS

| | | | |
|---|---|---|---|
| 2,186,338 | 1/1940 | Mills | 220/288 |
| 2,997,206 | 8/1961 | Vandegaer et al. | 220/375 |
| 3,019,997 | 2/1962 | Wooster | 242/55.42 |
| 3,235,196 | 2/1966 | Platt | 242/55.53 |
| 3,292,874 | 12/1966 | Tinkham | 242/55.2 |
| 3,413,049 | 11/1968 | Smay | 242/55.53 |
| 3,593,936 | 7/1971 | Davis | 242/55.2 |
| 3,704,776 | 12/1972 | Collins | 206/389 |
| 3,865,323 | 2/1975 | Stronge et al. | 242/55.53 |
| 4,273,392 | 6/1981 | Stinson | 206/394 |

*Primary Examiner*—William Price
*Assistant Examiner*—Jimmy G. Foster
*Attorney, Agent, or Firm*—Bernard G. Fehringer

[57] ABSTRACT

A cylindrical receptacle for holding a winding of sheet material with a hollow core such as toilet paper or paper towels has a central fixed guide member, a sliding guide member, retainers to keep the sliding guide member from disengaging the fixed guide member and to keep the winding from sliding off the sliding guide member and a cap to close the open end of the cylindrical receptacle. The joining of the cap and receptacle body can be made water proof to keep the contents dry. A hanger can be attached to the closed end of the cylindrical receptacle so that the open end hangs downward allowing the paper roll to slide out of the cylinder, yet be retained by the sliding member and retainer in such a manner as to allow easy unrolling of the paper roll.

7 Claims, 6 Drawing Figures

RECEPTACLE FOR ROLL OF SHEET MATERIAL

This invention relates generally to receptacles for rolls of sheet material having a hollow core such as various forms of paper although other materials such as gauze are also contemplated.

A principal object of the present invention is to provide a receptacle for rolls of sheet material to allow portability and yet provide protection from damage which might render all or a portion of the roll unusable.

Another object of the present invention is to provide a receptacle for rolls of sheet material which also allows easy unrolling or dispensing of the contained material.

Another object of the invention is to provide a receptacle for rolls of sheet material which is water proof.

Other objects of the invention are to provide a simple design of easy manufacture, is rugged, easy to use and has few moving parts none of which can rust, corrode or jam in moist conditions.

These and other objects will be readily evident upon a study of the following specification and the accompanying drawings wherein.

Figure 1:
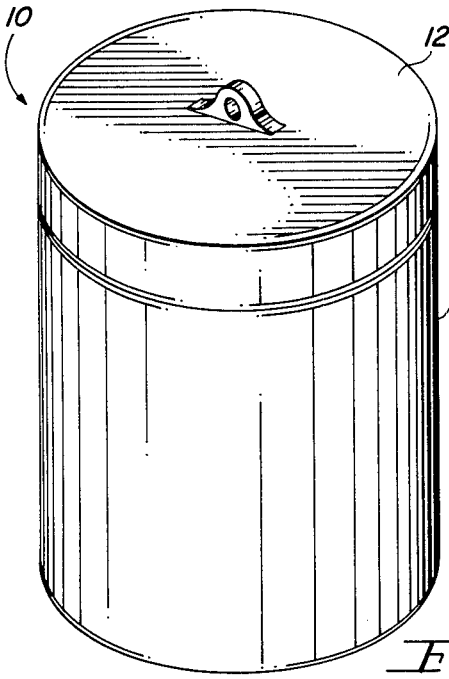
FIG. 1 is a perspective view of the present invention showing the cap removably attached to the open end of the cylindrical receptacle.

Refering now to the drawings in detail, FIG. 1 shows an embodiment of this invention, namely a cylindrical receptacle shown generally at 10 comprising a cylindrical portion 11 and a cap 12 removably attached to the open end of said cylindrical portion.

Figure 2:
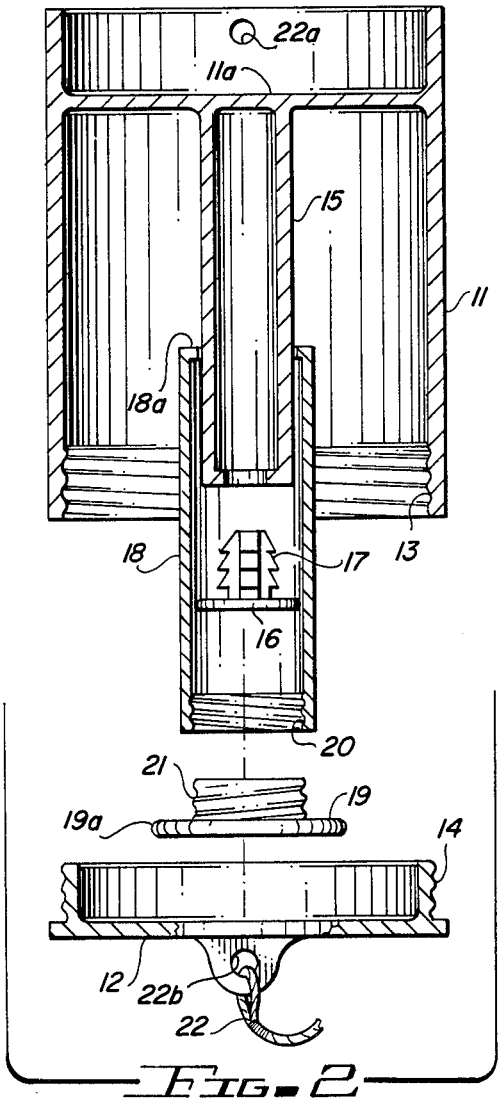
FIG. 2 is a cross sectional view of the present invention showing the cap removed and the retainers disengaged from the guide members.

FIG. 2 shows the cylindrical portion 11 having a closed end 11*a* and an open end. The closed end 11*a* has a fixed longitudinal guide member 15 centrally positioned and attached to said closed end. A sliding guide member 18 is adapted and arranged to slide longitudinally over the longitudinal guide member. A retainer 16 having an engaging means such as barbs 17 is inserted in a cavity in guide member 15 and keeps the sliding guide member from disengaging from the fixed guide member by means of a lip or ridge 18*a* on the inside of sliding guide member 18. Alternatively, the sliding guide member can be kept from disengaging from the fixed guide member by other retaining means such as a ridge (not shown) on fixed guide member 15 which is slightly larger that the lip or ridge on sliding guide member 18. A second retainer means 19 is provided which has threads 21 to allow removable attachment to the sliding guide member 18 by means of threads 20 on the inside of said sliding guide member. A lip 19*a* is provided on retainer 19 which is larger than the diameter of sliding guide member 18 and larger than the hollow core of the roll of sheet material. Cap 12 can be removably attached to cylindrical receptacle 11 by means of threads 14 on said cap which engage with threads 13 near the open end of the cylindrical receptacle. The cap can be prevented from being lost when detached from the cylindrical receptacle by means of a cord 22 through an attachment hole, the other end of said cord being attached to the cylindrical receptacle by any convenient means such as a hole in a lip or an eylet on the closed end of the receptacle.

Figure 3:
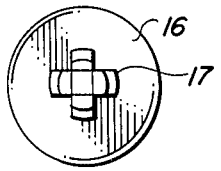
FIG. 3 is a top plan view of the retainer for the sliding guide.

FIG. 3 shows retainer 16 with a better view of the portion thereof which engages the lip of sliding guide member 18. The cross sectional view of the barbs which engage the cavity of the fixed guide member 15 are also shown.

Figure 4:
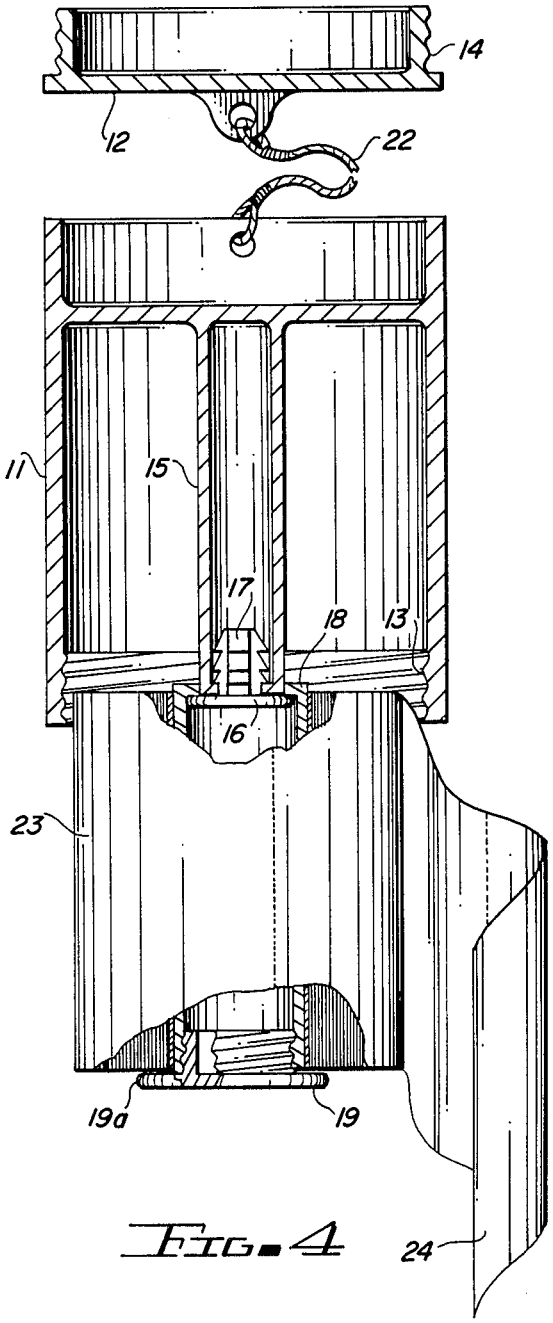
FIG. 4 is a cross sectional view of the receptacle showing the retainers in place, the sliding guide member fully extended and a roll of sheet material inserted over the sliding guide member and in position for dispensing.

FIG. 4 shows much the same view as FIG. 2 except that the sliding guide member 15 is shown fully extended from the cylindrical receptacle 11 and a roll of sheet material 23 with a hollow core, in this case, toilet tissue is shown installed on sliding guide member 18 with some sections 24 of the outer layer shown unrolled. This figure also shows that lip 19*a* of retainer means 19 is larger than the diameter of the hollow core to keep the roll of sheet material from sliding off from sliding guide member 18. This figure also shows that cap 12, attached to cylindrical receptacle 11 by cord 22 could be wrapped around or tied to a tree branch or other support to hold this device for easy dispensing of the roll of sheet material.

Figure 5:
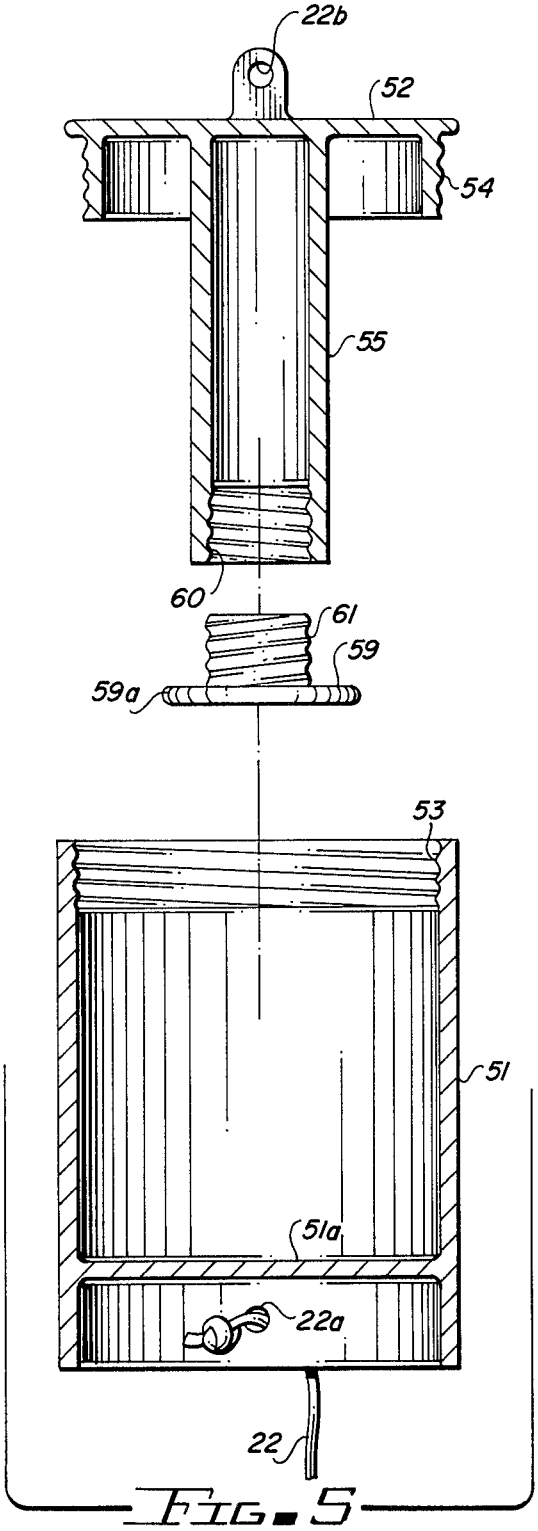
FIG. 5 is a cross sectional view of an alternate embodiment of the receptacle of this invention showing the cap removed and the retainer disengaged from the guide member.

FIG. 5 shows the cylindrical portion 51 having a closed end 51*a* and an open end. A cap 52 is removably attached to cylindrical portion 51 by threads 53 on the inside of the cylindrical wall of the open end of cylindrical portion 51 and threads 54 on the outside of a cylindrical portion of cap 52. Cap 52 has fixed longitudinal guide member 55 centrally positioned and attached to the inside of said cap. A retainer 59 such as the second retainer means 19 of FIG. 2 is provided which has threads 61 to allow removable attachment to the guide member 55 by means of threads 60 on the inside of said guide memer 55. A lip 59*a* is provided on retainer 59 which is larger that the diameter of guide member 55 and larger than the hollow core of the roll of sheet material. The cap and cylindrical portion can be prevented from getting separated by means of a cord 22 through an attachment hole 22*b* on the top of cap 52, the other end of said cord being attached to the cylindrical receptacle by any convenient means such as a hole 22*a* in a lip or an eylet on the closed end of the receptacle.

Figure 6:
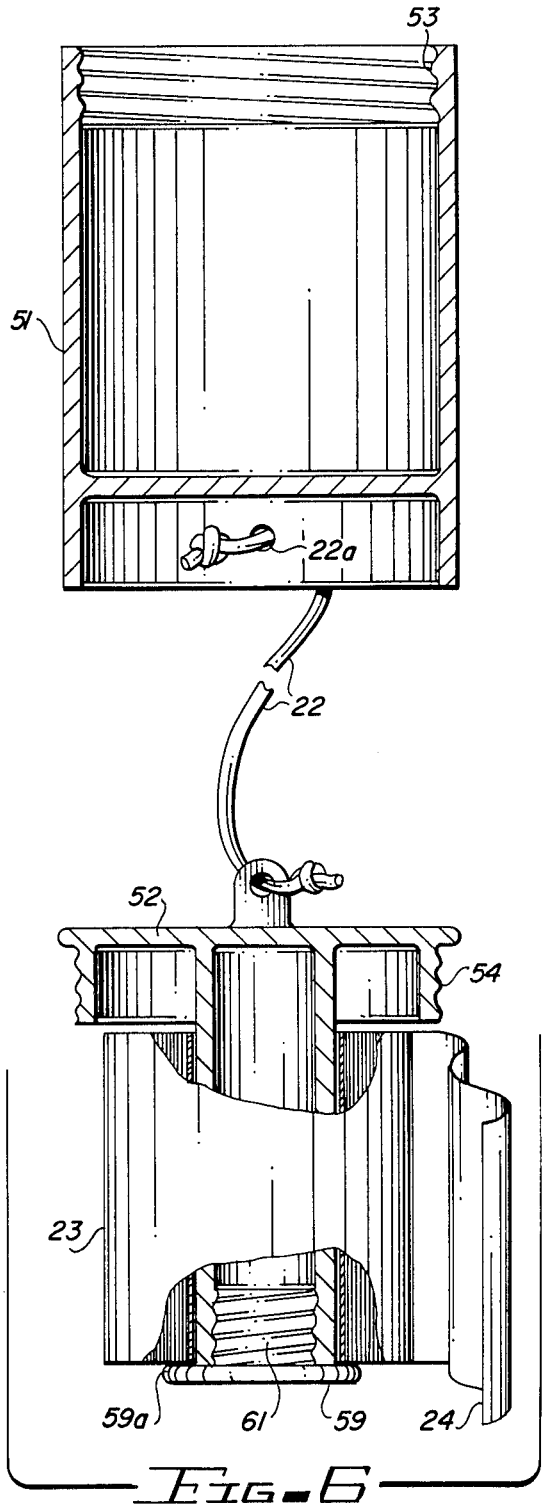
FIG. 6 is a cross sectional view of an alternate embodiment of the receptacle of this invention showing the retainer in place, a roll of sheet material inserted over the guide member in position for dispensing, and the cap removed so that the sheet material can be dispensed.

FIG. 6 shows much the same view as FIG. 5 except that a roll of sheet material 23 with a hollow core, in this case, toilet tissue is shown installed on the fixed guide member 55 with some sections 24 of the outer layer shown unrolled. This figure also shows that lip 59*a* of retainer means 59 is larger than the diameter of the hollow core to keep the roll of sheet material from sliding off from fixed guide member 55. This figure also shows that cylindrical receptacle 51, attached to cap 52 by cord 22 could be wrapped around or tied to a tree branch or other support to hold this device for easy dispensing for the roll of sheet material.

The embodiment of this invention shown in FIGS. 5 & 6 has the advantage over the embodiment shown if FIGS. 2 & 4 in that it has three instead of five parts which could reduce the cost of production. However, due to the need for fixed guide member 55 to be longer than the combined length of fixed guide member 15 and sliding guide member 18 so that the roll of sheet material 23 may be dispensed without interference from the cylindrical portion of cap 52 having threads 54, the length of cylindrical receptacle 51 must be longer that cylindrical receptacle 11. This can increase tooling costs for the molding dies.

Various changes and alterations may be made in the detailed construction of this invention such as different retaining means for both the sliding member and the roll of sheet material, reversing the location of the male and female threads of the second retaining means and the cap and cylindrical receptacle body or using ridges and lips instead of threads or barbs for the two different retaining means and the cap and receptacle body. It is understood that such changes and alterations will be within the spirit and scope of the present invention as defined by the appended claims.

What I now claim is:

1. A receptacle for holding a winding of sheet material having a hollow core comprising a cylindrical receptacle and a cap adapted and arranged to engage said cylindrical receptacle to form a watertight enclosure, said cylindrical receptacle having an open end, a closed end, and a centrally positioned fixed longitudinal guide member having a cavity at a free end and having an opposite end attached to said closed end, a sliding guide member adapted and arranged to slide longitudinally upon said fixed longitudinal guide member and adapted to fit inside the core of a roll of sheet material having a hollow core, lip means extended inwardly of said sliding guide member, retainer means adapted and arranged to prevent said sliding guide member from disengaging from said longitudinal guide member by means of said lip means, said retainer means being removably attached with said cavity, second retainer means adapted and arranged to prevent a roll of material from disengaging from said sliding guide member, said second retainer means removably engaged with said sliding guide member to allow the insertion over and removal from said sliding guide member of a roll of material with a hollow core, said cap removably attached to said open end of said cylindrical receptacle.

2. The receptacle according to claim 1 wherein said cap is adapted and arranged to be removably attached to said open end by screw threads.

3. The receptacle according to claim 2 wherein said second retainer means is removably engaged with said sliding guide member by screw threads.

4. The receptacle according to claim 2 wherein said second retainer means is removably engaged with said sliding guide member by a ridge.

5. A receptacle for holding a winding of sheet material having a hollow core comprising a cylindrical receptacle and a cap adapted and arranged to engage said cylindrical receptacle to form a watertight enclosure, said cylindrical receptacle having an open end and a closed end, said cap removably attached to said open end of said cylindrical receptacle, said cap having a centrally positioned fixed longitudinal guide member attached to the inside of said cap, said longitudinal guide member adapted to fit inside the core of a roll of sheet material having a hollow core, and retainer means to prevent a roll of sheet material from disengaging from said fixed longitudinal guide member when said cap is removed from said cylindrical receptacle, said retainer means removably attached to the end of said fixed longitudinal guide member most distant from said cap to allow the insertion over and removal from said fixed longitudinal guide member of a roll of material with a hollow core.

6. The receptacle according to claim 5 wherein said cap is adapted and arranged to be removably attached to said open end by screw threads.

7. The receptacle according to claim 6 wherein said retainer means is removably engaged with said fixed longitudinal guide member by screw threads.

* * * * *